US007788739B1

(12) United States Patent
Della Ratta

(10) Patent No.: US 7,788,739 B1
(45) **Date of Patent: *Sep. 7, 2010**

(54) MALE FERTILITY ENHANCEMENT GARMENT

(76) Inventor: Peter C. Della Ratta, 147 Barrett St., Schenectady, NY (US) 12305

( * ) Notice: Subject to any disclaimer, the term of this patent is extended or adjusted under 35 U.S.C. 154(b) by 1156 days.

This patent is subject to a terminal disclaimer.

(21) Appl. No.: 11/360,364

(22) Filed: Feb. 23, 2006

Related U.S. Application Data

(63) Continuation-in-part of application No. 10/739,257, filed on Dec. 18, 2003, now Pat. No. 7,024,703.

(51) Int. Cl.
*A41B 9/02* (2006.01)
*A41B 9/00* (2006.01)

(52) U.S. Cl. ..... 2/403; 2/400

(58) Field of Classification Search ..... 2/400–406, 2/228, 238, 227; 604/385.01–396; 602/67–72
See application file for complete search history.

(56) References Cited

U.S. PATENT DOCUMENTS

| | | | | | |
|---|---|---|---|---|---|
| 587,545 | A * | 8/1897 | Cobb | 156/148 |
| 3,621,846 | A | 11/1971 | Lehman | |
| 4,195,630 | A * | 4/1980 | Connery et al. | 602/67 |
| 4,660,551 | A * | 4/1987 | Nishimura | 600/41 |
| 5,029,345 | A * | 7/1991 | Angheluta et al. | 2/403 |
| 5,157,793 | A * | 10/1992 | Michels | 2/403 |
| 5,283,912 | A * | 2/1994 | Chung | 2/403 |
| 5,290,270 | A * | 3/1994 | Fisher | 604/387 |
| 5,524,298 | A * | 6/1996 | Plunkett | 2/403 |
| 5,598,587 | A * | 2/1997 | Wada | 2/403 |
| 5,647,065 | A * | 7/1997 | Richerson | 2/403 |
| 5,870,779 | A * | 2/1999 | Heron | 2/403 |
| 6,061,840 | A * | 5/2000 | Alligator | 2/403 |
| 6,245,036 | B1 * | 6/2001 | McRoberts et al. | 602/67 |
| 6,295,651 | B1 * | 10/2001 | Kang | 2/403 |
| 6,862,746 | B2 * | 3/2005 | Cym et al. | 2/403 |
| 7,024,703 | B1 * | 4/2006 | Della Ratta | 2/403 |

FOREIGN PATENT DOCUMENTS

| | | | | |
|---|---|---|---|---|
| WO | WO02/15726 | * | 2/2002 | 2/400 |

* cited by examiner

*Primary Examiner*—Gloria Hale
(74) *Attorney, Agent, or Firm*—F. T. Morelle

(57) ABSTRACT

A male undergarment providing a comfort barrier between the groin and outerwear with enhancements for promoting male fertility. By use of less restrictive (and confining) clothing adjuncts to the conventional undergarment, an environment for genitalia, primarily the testes, is acquired that will reduce the level of body heat accumulating in the zone or regions proximate those organs. Elements are used that will reduce the normally existing temperatures: a dam, consisting minimally of a fabric partition, for compartmentally segregating genitalia from the loins; thermally isolation, by use of suitable insulative/reflective fabrics, on the dam and between the segregated organs and groin regions; and, a vented, independent, scrotal compartment. Contrary to the modern norm, the genitalia are allowed to assume a more natural, pendulous suspension, one more conducive to the vitality of spermatozoa.

8 Claims, 4 Drawing Sheets

FIG. 1
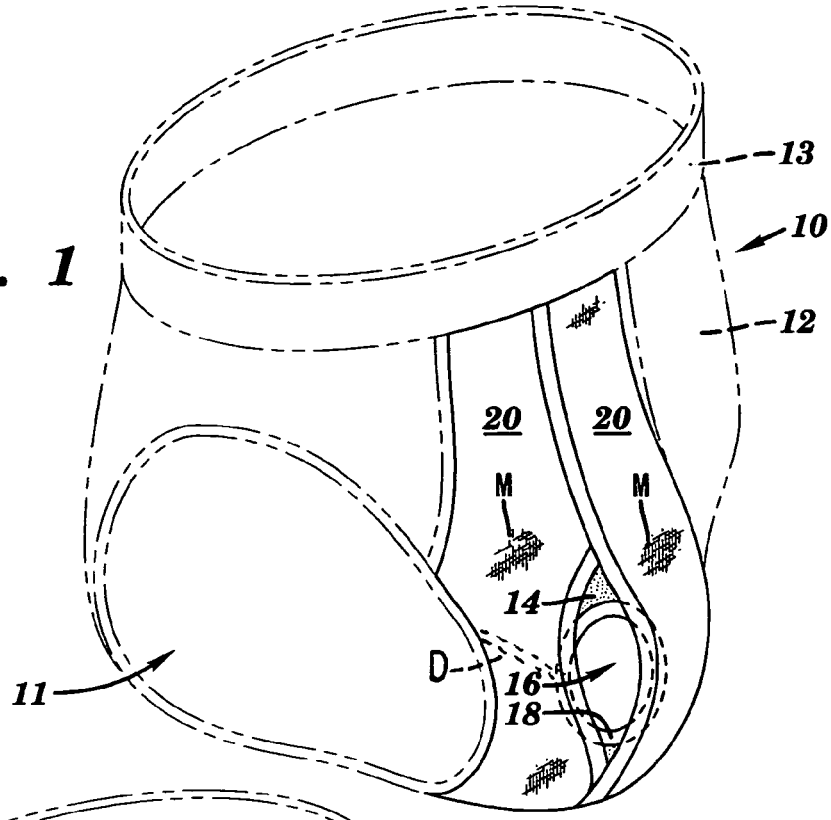
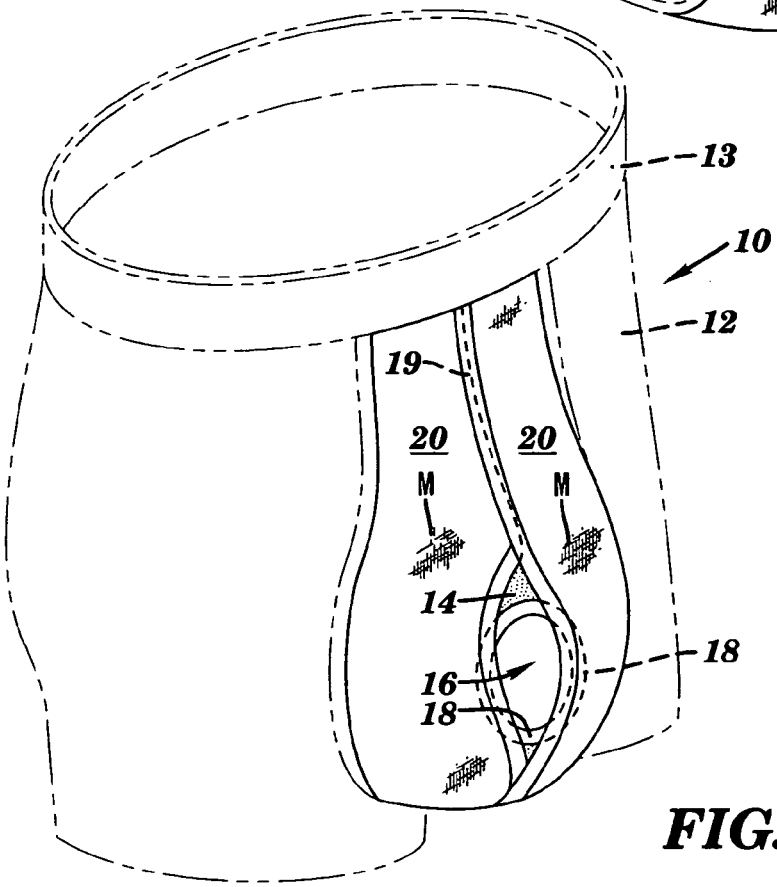
FIG. 5

MALE FERTILITY ENHANCEMENT GARMENT

CROSS-REFERENCES TO RELATED APPLICATIONS

This is a Continuation-in-Part of application Ser. No. 10/739,257, filed by the same inventor on Dec. 18, 2003, now U.S. Pat. No. 7,024,703, issued on Apr. 11, 2006, entitled: Male Fertility Enhancement Garment, and for which priority is claimed.

STATEMENT REGARDING FEDERALLY SPONSORED RESEARCH OR DEVELOPMENT

Not Applicable

BACKGROUND OF THE INVENTION

1. Field of the Invention

This invention relates generally to male underwear and specifically to a type of undergarment, irrespective of style, that is configured with a discrete front panel to thermally isolate the genitalia from immediate contact with the extreme lower abdomen and upper thighs, i.e., groin regions. Additional to organ-body segregation, selective insulation and/or reflective materials are employed to effect a thermal barrier.

2. Discussion of Relevant Art

Many attempts have been made to enhance male undergarments, for various purposes, including the erotic. The latter, however, is deemed beyond the scope of this disclosure. It is well settled, in the field of medicine, that the close confinement of genitalia, in modern male undergarments, is thermally deleterious to the production of healthy, motile and viable sperm. It is intended here to provide the field of fertility therapy with a garment that does not diverge significantly, in design and function, from conventional underpants, e.g., briefs, shorts or tights. Further, the instant invention, shown in two basic embodiments, is designed to be non-obtrusive, comfortable and unlikely to attract attention to its user in polite society or in public rest rooms. To achieve the function of fertility enhancement, it is necessary to avoid the tendency to wear tight pants or trousers, which is often considered stylish. Unfortunately, body heat generated at the groin area of the body (including the lower abdomen and upper thighs) is often inimical to the male seed. While nature has provided the scrotum, which is pendant by design, to hold the testicles sufficiently away from the body's groin region, so as to maintain a thermal environment conducive to sperm viability, such protection is negated by clothing styles—particularly, underwear. Modern styles (of underpants, briefs, thongs and tights) take forms ranging from boxer shorts, which allow a modicum of scrotal freedom, to highly restrictive and scrotal-confining tights, pouches, thongs and "trunks". Combined with the wearing of trousers, of even the "regular cut" style, it is intuitive that the temperature in the scrotum will far exceed that of nature's intended environment. There have been many attempts to stylize men's briefs, for many reasons too numerous to address here; however, a search of the U.S. Patent Office Patent Database has yielded a number of patents drawn to such stylization, for whatever reason.

Regarding the search, the patents issued to Connery, et al., U.S. Pat. No. 4,195,630 ('630), and Angheluta, U.S. Pat. No. 5,029,345 ('345), are the most relevant. Connery discloses a scrotal cup inside both briefs and shorts, with a pocket section for the penis. Essentially, he shows compartmentalization and segregation in basic form, but with the scrotum contained within the brief, proper. Angheluta shows a brief that is essentially that of '630, but falls short of it in that the scrotum and penis are neither segregated nor separated by insulation material (the patentee merely alleges insulation by the process of placing the scrotum/penis pouch forward of the brief front panel). Connery cannot be said to have suggested separation of the scrotum and penis from the high thermal groin environment because he has retained the scrotal pouch inside the brief (using solely a thong). Richerson, U.S. Pat. No. 5,647,065 ('065) shows a variation of Angheluta that appears to raise the pouch for the purposes of displaying the covered genitalia more prominently. The article appears to exaggerate size of, and closely confine, the scrotum and penis to the upper groin area, thus losing the pendulous, cooling effect of their natural suspension. The Lehman patent, U.S. Pat. No. 3,621,846 ('846), discloses what can be truly characterized as a "brief", or "thong"; it is effectively an athletic supporter that contains the scrotum in a pouch adjacent to the loin/groin area and allows the penis to hang outside the pouch, covered only by a flap or codpiece. The main limitation of '846 is that it performs primarily an athletic support's function, by clearly constraining any scrotal freedom, but confining it snuggly within the groin area. Plunkett, U.S. Pat. No. 5,524,298 ('298), is an evolution of the Lehman article in that the "brief" of '846 is avoided almost entirely. Here, '298 is a modification of the support, with segregation from the penis and without buttock-encircling straps. The pouch of this garment is essentially the same as '846 and, while the penis is allowed to escape and drape over the top of the pouch, to be covered by a flap element, the article suffers the same limitations as the Lehman device. Although emulating the scrotal pendulum, the device nevertheless confines both organs closely to the groin region. None of the above art provides the instant invention's unique thermal barrier and purposeful ventilation.

INCORPORATION BY REFERENCE

Because they show the provision of front panel apertures in men's briefs, as well as the addition of genital organ containment, the following patents to: Connery, et al., U.S. Pat. No. 4,195,630 ('630); Angheluta, U.S. Pat. No. 5,029,345 ('345); and, Richerson, U.S. Pat. No. 5,647,065 ('065), are hereby incorporated by reference.

DEFINITIONS

Most terms used herein are to be taken as having their customary English meaning. When different or secondary definitions may be applied, I have, with their first use and absent common usage, given their intended meanings in parentheses. A few terms, however, are to be read with the following meanings (especially, in the Claims):

breathable—having capability of ventilation, e.g., mesh fabric;

codpiece—a flap element at the front of a pant garment, covering the penis;

col—a saddle or U-shaped passage or region;

constrain—to restrain in the sense of holding back or holding closely together;

ensemble—an assembly of parts, e.g., as in a set or article of clothing;

fly—a form of codpiece that is pulled open transversely with respect to the body, and is comprised of two overlapping pieces of the pant;

panel—as used herein, merely the undergarment portion containing the invention; and pant(s), also underpants—for the purpose of this disclosure and the appended claims, any of the male undergarments receptive of the instant improvements.

BRIEF SUMMARY OF THE INVENTION

The limitations of the relevant art are overcome with this concept of a male undergarment that, in addition to providing comfort and thermal barriers between the groin and outer wear, greatly enhances male fertility through usage of less restrictive (and confining) garment adjuncts to the conventional male undergarment, e.g., "briefs", "shorts", "thongs" or "tights". This is done by combining elements that would promote: (1) a purposeful segregation of genitalia from the groin region—alternatively, the penis from scrotum and the latter from the loins; (2) thermal insulating/reflective material between segregated organs and groin region, to obtain a heat barrier; and, (3) the venting of the independent, scrotal compartment which allows pendulous suspension of the testes.

A first embodiment is applied to the more familiar conventional undergarments (hereinafter, "pants" or "briefs" may be used with the understanding that the invention improvements may be applied to practically any form of male underwear). A singular dam or like opening is provided in the front panel of the briefs over/through which, upon dressing, the scrotum and penis are passed. The stylized "dam" has a twofold effect: first, it physically segregates the genitalia from the lower abdomen and loins, perhaps the naturally warmest area of the body; and second, it is styled in a placement such that, when the garment wearer sits, the scrotum will be prevented, by the interdiction of the "dam", from moving rearward and out of the dressed posture. A pouch is provided, conterminously attached to the front panel, or at least to the hole (dam), in order to receive therein the male organs. This pouch is fashioned with any of the conventional fly apertures or codpieces, to aid in releasing the penis for bladder relief. The entire pouch, or a goodly portion of it, is constructed of a breathable fabric that serves to ventilate the organ(s) thus contained. Interposed the containment (pouch) and the front panel of the briefs is a thermal-insulation, or heat-reflective, material which may be attached to the front panel or, in itself, form the panel. An optional light elastic band forms the hem or piping of the front panel aperture (if it is but a simple hole). Such an arrangement ensures that ordinary bodily movement, such as sitting, crouching or running, will not cause the scrotum to be withdrawn inadvertently from the pouch, thus serving also as a dam, which is a physical barrier.

The alternate embodiment consists likewise of the conventional underpants or briefs, with an opening provided in the front panel of the briefs through which, upon dressing, the scrotum and penis are passed. A bifurcated or dual pouch is provided, again, conterminously attached to the front panel, in order to receive in one part the scrotum, and in the other, the penis. This dual pouch ensemble is far less constraining than that of the first embodiment, because it avoids the more conventional design, wherein the genitalia are confined tightly into the groin area. The pouches of this modality are made, preferably, of a soft mesh fabric. Insulative or reflective material, as aforementioned, covers the preponderance of the front panel, as well as a band about the back, bottom and front of the scrotal pouch (compartment) and on the underside of the open-ended pouch (tube) that receives the penis. Thus, the penis may be insulated from the scrotum, while the latter is insulated from the brief front panel and groin area. In lieu of the fly aperture, there is provided a front (over the penis containment) flap or codpiece. Further to this latter embodiment, and as an economical expedient, the invention is realized by inserting the dam in the lower portion of the front panel, between the outer flap, codpiece or pouch. It is clearly the dam that is of importance.

BRIEF DESCRIPTION OF THE SEVERAL VIEWS OF THE DRAWINGS

Of the Drawings:

FIG. 1 is an illustration of the nominal undergarment of the invention, a (set of) briefs embodying the invention;

FIG. 5 is an illustration of a pair of tights displaying the invention.

DETAILED DESCRIPTION OF THE INVENTION

Figure 2:
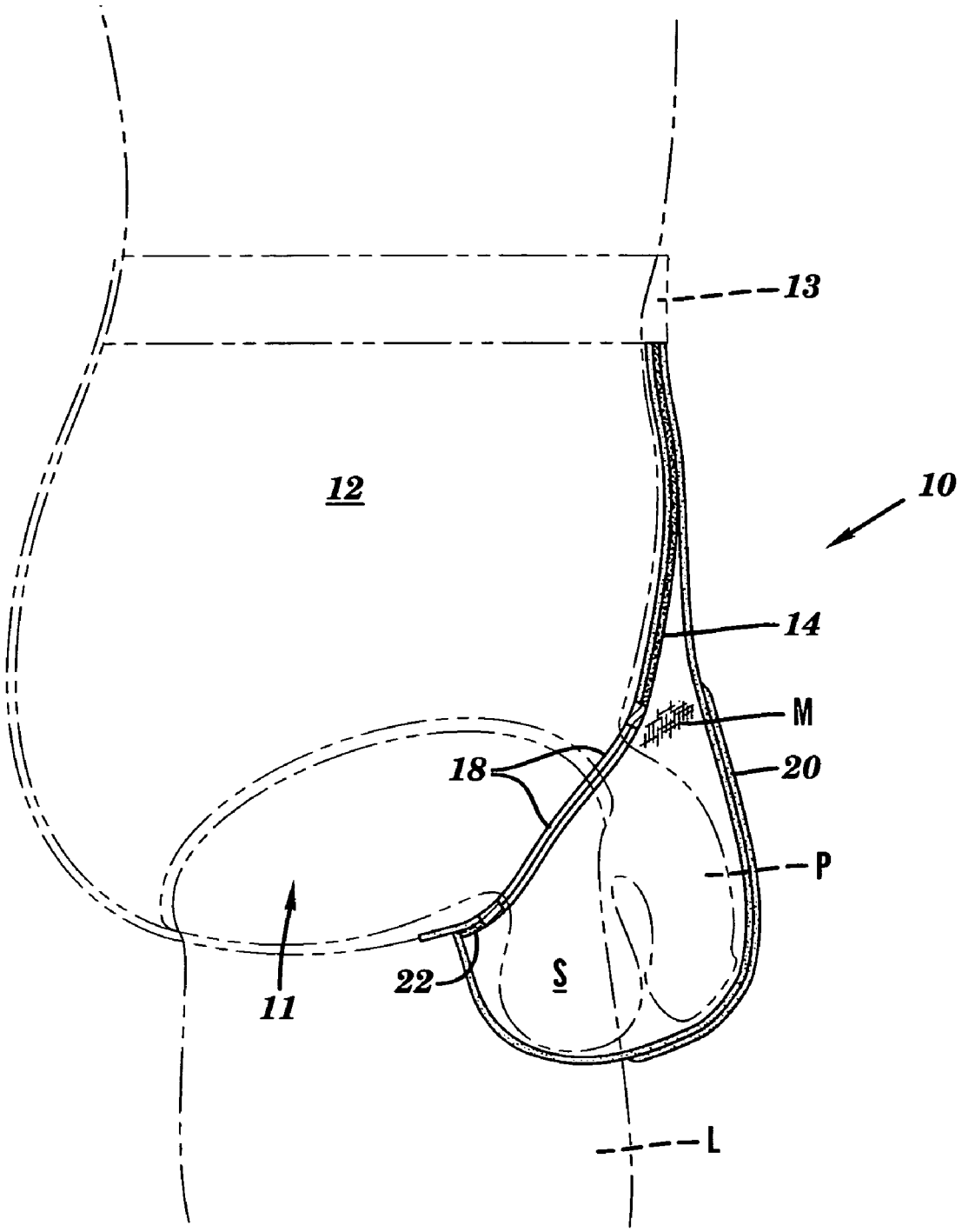
FIG. 2 is an cross sectional elevation, in partial phantom, of the FIG. 1 article.

The general thrust of this disclosure is to present the design of a male undergarment that will enhance fertility by promoting a more temperate and natural environment for the testicles, without wandering afar of modern style or human dignity. For this reason, particularly the latter, but with an eye toward optimizing sperm motility, there is avoided the practice of engaging and lifting the genitalia; instead, they are postured in a more natural, pendulous state. This is indeed the reason that nature provides a pendant scrotum—to avoid the excessive, sperm threatening body heat that accumulates within the groin area of the male. The improvements made to the customary male underwear are: physical segregation (physical barrier) of the genitalia from the wearer's groin or crotch area, by passing them over a material dam; thermal isolation (thermal barrier) of the genitalia from that body area, by the dam—which is the bottom portion of the panel; in an alternate embodiment, discrete compartmentalization of scrotum and penis; and, ventilation of the genitalia by the use of breathable fabric, such as a soft, cotton/polyester mesh. The invention will be better appreciated with a detailed description, in view of the drawings.

Referring to FIG. 1, the invention 10 comprises a conventional male undergarment 12 that encompasses the hips, buttocks, lower abdomen, groin and, in some versions, the upper thighs. The garment shown is common to its counterparts of the genre, in that it shows the elastic waistband 13, leg ports 11 and pocket-fly 20 (termed "pouch", in the first-shown embodiment of the invention); the latter being a particular type of codpiece. In this illustration, the buttock- and hip-covering portions of the brief are shown as a fabric; but, were this invention applied to that type of undergarment known as the thong, the principal parts—waistband 13, front panel 14 and fly cum pouch 20—would still be realized, with but one or two straps (not shown), passing under the saddle or col portion of the garment, to the waistband. It is not intended to dwell on the various types of male undergarments, but rather to illuminate the reader as to the particular improvements that constitute the instant invention. These can be applied to almost all such garments for the purpose of enhancing sperm vitality, as well as offering to the wearer more than a modicum of natural comfort.

Continuing in FIG. 1, and adding comfort to the more natural suspension of the genitalia, is the use of a soft mesh M fabric that composes most (to all) of the pouch 20. The front panel 14 is unique to this genre by its singular aperture construction, combined with thermal-reflection/insulation fabric of practically any type used in the clothing industry, e.g., the reflective fabrics employed by ClimaCool® (bilayered light/dark materials) or the thermal insulating fabrics used by the U.S. military (polypropylene), Duofold® bi-layer (cotton/wool) and Medalist® (polyester). Within the scope of this invention, washable, heat-reflective/insulative materials are used not only on the front panel, but also on thigh portions of the garment to further isolate the pouch area 20 from the body heat of the wearer.

In this embodiment, use of a low aperture 16, disposed in the special front panel 14, allows easy passage of the genitalia, through the elastic-hemmed 18 aperture 16, the bottom of which may be termed the dam D. The reader should note that the aperture need not be of circular design. In the invention's most salient aspect, the dam D, which consists of only a partition at the lower portion of the brief, allowing the genitalia to be isolated and captured between the thigh area and the outer pouch 20, fulfills the most important objective of the inventor. The use of elastic hemming is to assure that, whatever the aperature may be, its lower margin must be a true dam, i.e., it must be low enough, so that it does not raise or "boost" the scrotum, but yet high enough to prevent it from slipping back behind the dam, when the wearer sits. The conventional front panel-fly is permuted to a pouch form 20 and now serves the dual purpose of providing a vented and insular containment of the genitalia, while still allowing extraction of the penis for urination.

The cross-sectional side elevation of FIG. 2 presents the invention 10, with a somewhat exaggerated posture of the genitalia, in order to clearly define the elements of the improvements. Parts of the conventional brief, as well as physical body parts, are shown (in phantom) as buttock-hip covering 12, waistband 13 and leg L, scrotum S, penis P, respectively. It may be seen that the special front panel 14 of the brief is used in lieu of the conventional panel and the elastic-hemmed 18 aperture 16 receives passage of the genitalia there through, into the pouch 20. A portion of the special reflection/insulation panel is shown in the col-dam 22 region, to indicate that it (reflectivity/insulation) is carried below the scrotum and on to the lower portion of the pouch, to further insulate the scrotum S from body heat in the upper thigh-crotch area. Most of the pouch construction, however, should be of a breathable fabric, such as the earlier-suggested mesh M.

Figure 3:
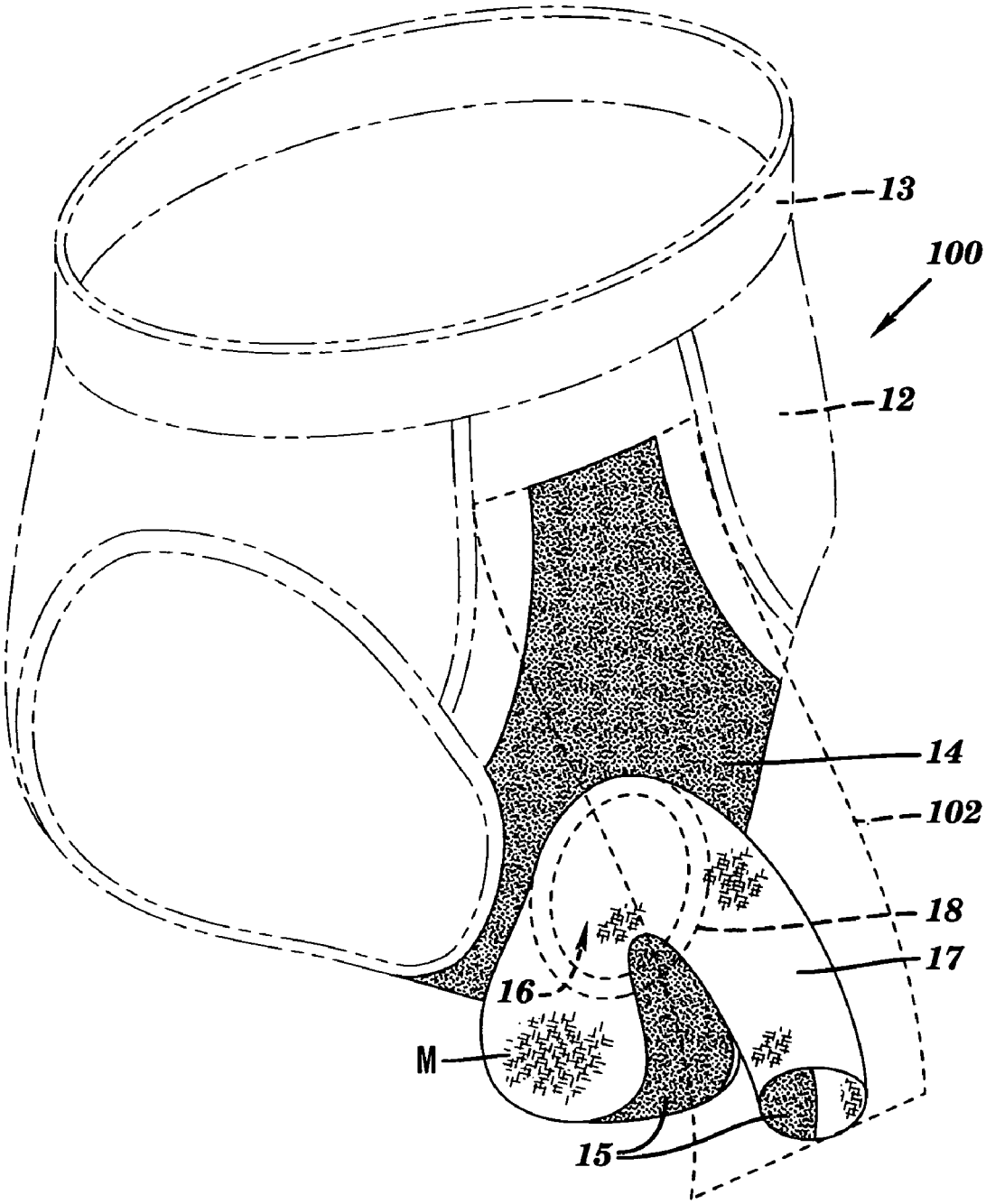
FIG. 3 is an illustration of the alternate embodiment of the invention.
Figure 4:
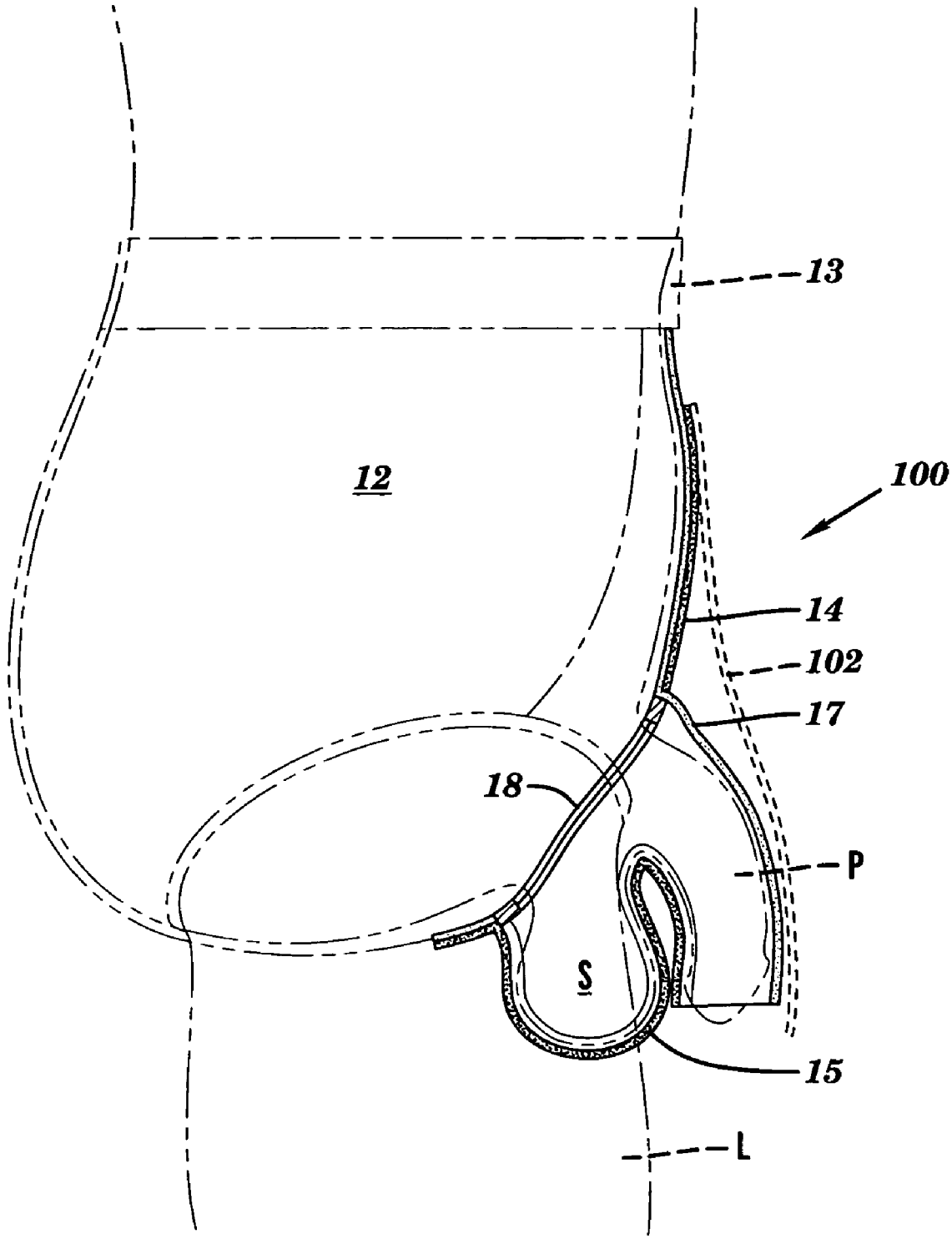
FIG. 4 is a cross sectional elevation, in partial phantom, of the FIG. 3 article.

The alternate embodiment 100 of my invention, as seen in FIGS. 3 and 4, bears many of the elements of the first embodiment 10. Insofar as the improvements however, the frontal pouch is dispensed with in favor of a bifurcated pouch 17 consisting of a scrotal pouch or compartment, communicating with its compliment, a tubular, open-ended sleeve; the latter being receptive only of the penis P. Distinctions are noted in that: the insulated panel 14 is a potion that covers only part of the front panel, but all of the groin area; and, an exception is made to a preponderant mesh M construction of the pouch 17, by use of a partial insulation strip 15 that runs from the col region (FIG. 2 at 22) under and over the scrotal section of the pouch, but only under the tubular section that is reserved for the penis.

Under most circumstances, the arrangement of elements disclosed is sufficient to the invention. Depending on the over garment worn (trousers, jeans or shorts), more protection may be desired between the penis and the outerwear. To this end, the invention is fitted with the traditional codpiece 102 which, in keeping with the spirit of the invention, ought to be fabricated of breathable material.

What is claimed is:

1. A male undergarment comprising: a waistband, a buttocks and hip covering, leg ports, and having at least a defined front panel for coverage of genitalia at the lower extremis of a wearer's abdomen and proximate the groin area of a wearer of the undergarment:

said front panel featuring a singular aperture disposed there through and proximate said genitalia, said singular aperture structured for a displacement of the wearer's genitalia there through and forming a dam structure immediately below the scrotum of said wearer to prevent retrograde motion of the genitalia when the wearer sits, the front panel further including an insulation means thereon to thermally segregate the genitalia from said groin area; and a singular enveloping element perimetrically attached to the front panel, said element made of breathable fabric, for receiving therein said entire genitalia, said element superimposed over a preponderance of the panel, the element further comprising a pouch having disposed therein a fly and in which the entire genitalia, disposed over said dam structure, assume natural pendulous suspension.

2. The undergarment of claim 1, wherein said aperture is hemmed with a light elastic material.

3. The undergarment of claim 1, wherein said insulation means is a thermal insulating fabric overlain a substantial part of said front panel, thereby thermally isolating from said groin area the genitalia displaced and extending through said aperture.

4. The undergarment of claim 1, wherein the front panel is completely fabricated from a material selected from the class of materials consisting of bilayered light/dark materials, polypropylene, bi-layer cotton/wool, and polyester.

5. The undergarment of claim 1, wherein said pouch is constructed of a breathable, ventilating mesh fabric, thereby allowing an escape of genitalia heat from the pouch.

6. The undergarment of claim 1 wherein the insulation means is a fabric combination to effect heat reflection or insulation.

7. The undergarment of claim 1 wherein said dam structure is a singular opening hemmed with an elastic material for effecting a comfortable fitting of the dam about the root of the wearer's scrotum.

8. The undergarment of claim 5 wherein said mesh of said pouch is a soft cotton or cotton/polyester material.

* * * * *